US006494464B1

(12) United States Patent
Chandler et al.

(10) Patent No.: US 6,494,464 B1
(45) Date of Patent: Dec. 17, 2002

(54) GEL SEALANT ENCLOSURE WITH VISUAL SEAL INDICATION

(75) Inventors: Daniel A. Chandler, Menlo Park, CA (US); David W. Curry, Crowborough (GB)

(73) Assignees: Tyco Electronics Corporation, Middletown, PA (US); Aqua-Seal International Limited, East Sussex (GB)

( * ) Notice: Subject to any disclaimer, the term of this patent is extended or adjusted under 35 U.S.C. 154(b) by 0 days.

(21) Appl. No.: 09/556,170

(22) Filed: Apr. 20, 2000

(51) Int. Cl.[7] ..... F16J 13/00; F16J 3/00

(52) U.S. Cl. ..... 277/628; 277/630; 277/641; 277/321; 220/377

(58) Field of Search ..... 220/849, 377, 220/378, 212; 215/230; 277/316, 321, 628, 630, 641, 642, 650

(56) References Cited

U.S. PATENT DOCUMENTS

| | | | | |
|---|---|---|---|---|
| 2,827,197 A | | 3/1958 | Fiske | 220/50 |
| 3,055,808 A | | 9/1962 | Henderson | 195/139 |
| 3,902,057 A | * | 8/1975 | La Violette | 240/8.3 |
| 4,600,261 A | | 7/1986 | Debbaut | 339/116 C |
| 4,628,421 A | * | 12/1986 | Saar | 362/238 |
| 4,690,831 A | | 9/1987 | Uken et al. | 427/44 |
| 4,716,183 A | | 12/1987 | Gamarra et al. | 522/80 |
| 4,777,063 A | | 10/1988 | Dubrow et al. | 427/44 |
| 4,852,646 A | | 8/1989 | Dittmer et al. | 165/185 |
| 4,864,725 A | | 9/1989 | Debbaut | 29/871 |
| 4,865,905 A | | 9/1989 | Uken | 428/220 |
| 5,079,300 A | | 1/1992 | Dubrow et al. | 525/106 |
| 5,104,930 A | | 4/1992 | Rinde et al. | 524/871 |
| 5,415,713 A | | 5/1995 | Vatcher | 156/48 |
| 5,473,129 A | | 12/1995 | Markowski et al. | 200/293 |
| 5,562,295 A | | 10/1996 | Wambeke et al. | 277/34 |
| 5,631,068 A | | 5/1997 | Smith | 428/195 |
| 5,798,169 A | | 8/1998 | Smith | 428/212 |
| 5,822,180 A | | 10/1998 | Deschamps et al. | 361/627 |
| 5,907,125 A | | 5/1999 | Buekers et al. | 174/52.1 |
| 5,914,460 A | | 6/1999 | Mowery et al. | 174/50 |
| 5,958,529 A | | 9/1999 | Myong et al. | 428/34.9 |
| 5,996,790 A | | 12/1999 | Yamada et al. | 206/316.1 |

FOREIGN PATENT DOCUMENTS

| | | |
|---|---|---|
| DE | 288 888 C | 11/1915 |
| EP | 0 204 427 | 12/1986 |
| FR | 671 865 A | 12/1929 |
| WO | WO/86/01634 | 3/1986 |
| WO | WO/88/00603 | 1/1988 |

OTHER PUBLICATIONS

International Search Report for International Application No. PCT/US01/10927 dated Nov. 7, 2001.

* cited by examiner

*Primary Examiner*—Anthony Knight
*Assistant Examiner*—Enoch Peavey

(57) ABSTRACT

A sealable enclosure including a base and a cover attachable to the base, the base and cover have respective mating surfaces, wherein the base and cover form a chamber there between when the cover is attached to the base. A compliant gel sealant is disposed on the mating surface of one of the base and cover for environmentally sealing the chamber, with a visual indicator provided for determining that the chamber is sealed. In one preferred embodiment, the visual indicator comprises a non-opaque window formed in the cover, and a non-opaque tongue extending from the mating surface of the cover, the tongue aligned with the window such that a line of sight is provided through the respective window and tongue. The gel sealant is disposed in a mating groove located about a perimeter of the mating surface of the base and substantially aligned with the tongue when the cover is attached to the base, such that a wetted contact between the gel and a distal end of the tongue, indicating that an environmental seal is formed there between, is visible through the line of sight.

21 Claims, 5 Drawing Sheets

GEL SEALANT ENCLOSURE WITH VISUAL SEAL INDICATION

FIELD OF INVENTION

This invention relates generally to the use of gel sealants for environmentally sealable enclosures and, more particularly, to an environmentally sealable enclosure or assembly having a visual indicator for determining that the gel has formed a seal.

BACKGROUND OF THE INVENTION

Protection of panels, boxes, cases, or other enclosures is often required when they are employed in wet environments, for example in humid conditions or underwater, where moisture or water can enter the enclosure or in contaminated environments where gases or airborne particles can enter the enclosure. Items such as electrical connections, electrical boxes, electrical panels, or in non-electrical applications such as jewel cases, or other applications where sensitive items or equipment are in use, all benefit from environmental sealing.

Normally, such protection is provided by the use of seals including O rings or gaskets to protect against moisture, dirt, or particle ingress. Such seals often do not function effectively due to enclosures fabricated with loose tolerances, poor surface finishes, or warped parts all of which hinder the formation of a proper seal. A proper seal is also hindered by the lack of proper mechanical loading of the assembly. Too little mechanical loading will not compress the O rings or gaskets enough to form a seal while too much mechanical loading can create bulges in the O rings or gasket allowing leakage in the seal. Further, such sealing devices do not provide a visual indication of the proper seal formation or the lack of a seal to the operator.

Because of their extremely soft and compliant nature, gels are particularly suited for sealing enclosures and their use is known in the art. The benefit of using gels to seal enclosures is even more apparent for sealing enclosures fabricated with loose tolerances and poor surface finishes, or warped parts, all of which can be found in parts made from injected molded plastic. Unlike an O ring or a gasket, a gel can form a seal under the application of a very low compressive force. Unfortunately, the use of a low compressive force with an O ring or gasket provides little or no feedback to the operator of whether a seal is properly formed or not. A gel can also form a seal under high compressive forces.

The current use of gels does not allow any visual feedback to the operator or anyone else of whether or not a seal is properly formed. An indication of whether or not a seal is formed is especially important for the use of gels because their tacky nature makes them prone to picking up surface contaminates such as dirt, sand, or other particles. Such surface contaminates can prohibit the formation of a proper seal between the gel and the mating part.

SUMMARY OF THE INVENTION

In accordance with a first aspect of the invention, a sealable enclosure is provided, the enclosure including a base and a cover attachable to the base. The base and cover have respective mating surfaces, wherein the base and cover form a chamber there between when the cover is attached to the base. A compliant gel sealant is disposed on the mating surface of one of the base and cover for environmentally sealing the chamber, with a visual indicator provided for determining that the chamber is sealed.

By way of non-limiting example, the visual indicator may comprise a non-opaque window formed in the cover, and a non-opaque tongue extending from the mating surface of the cover, the tongue aligned with the window such that a line of sight is provided through the respective window and tongue. The gel sealant is preferably disposed in a mating groove located about a perimeter of the mating surface of the base and substantially aligned with the tongue when the cover is attached to the base. In this manner, a wetted contact between the gel and a distal end of the tongue, indicating that an environmental seal is formed there between, is visible through the line of sight.

In accordance with a further aspect of the invention, a sealable assembly is provided, the assembly including a fixed surface defining an opening, a compliant gel sealant disposed about the opening. The assembly further includes a cover attachable to the fixed surface so as to form a substantially moisture-tight seal between the interior cover surface and the gel, the cover providing a visual indication of whether or not a seal is formed by the gel.

As will be apparent to those skilled in the art, other and further aspects of the present invention will appear hereinafter.

BRIEF DESCRIPTION OF THE DRAWINGS

Preferred embodiments of the present invention are illustrated by way of example, and not by way of limitation, in the figures of the accompanying drawings, in which like reference numerals refer to like components, and in which.

DETAILED DESCRIPTION OF THE PREFERRED EMBODIMENTS

In accordance with the invention, an environmentally sealable enclosure or assembly is provided with a visual indicator for determining that a gel sealant has, in fact, formed a seal. The enclosure can be, for example, a box, a panel, a jewel case, an opening in a door, or some other assembly designed for the protection of items or sensitive equipment. The sealed enclosure or assembly can protect from water ingress, either from humid environments, water spray, or water immersion, or from contaminates such as dirt, sand, oil, or grease. The sealed enclosure is especially useful for the protection of electrical components such as electrical connections, panels, or boxes, which can fail to function or create hazardous conditions if exposed to water or other contaminates. In addition to electrical connections, the enclosure can be any assembly designed for the protection of sensitive items, such as jewelry cases, camera cases, document cases, or any other item, in which protection from the external environment is desired.

Referring to the accompanying drawings, preferred embodiments depicting various aspects of the invention will now be described.

Figure 1:
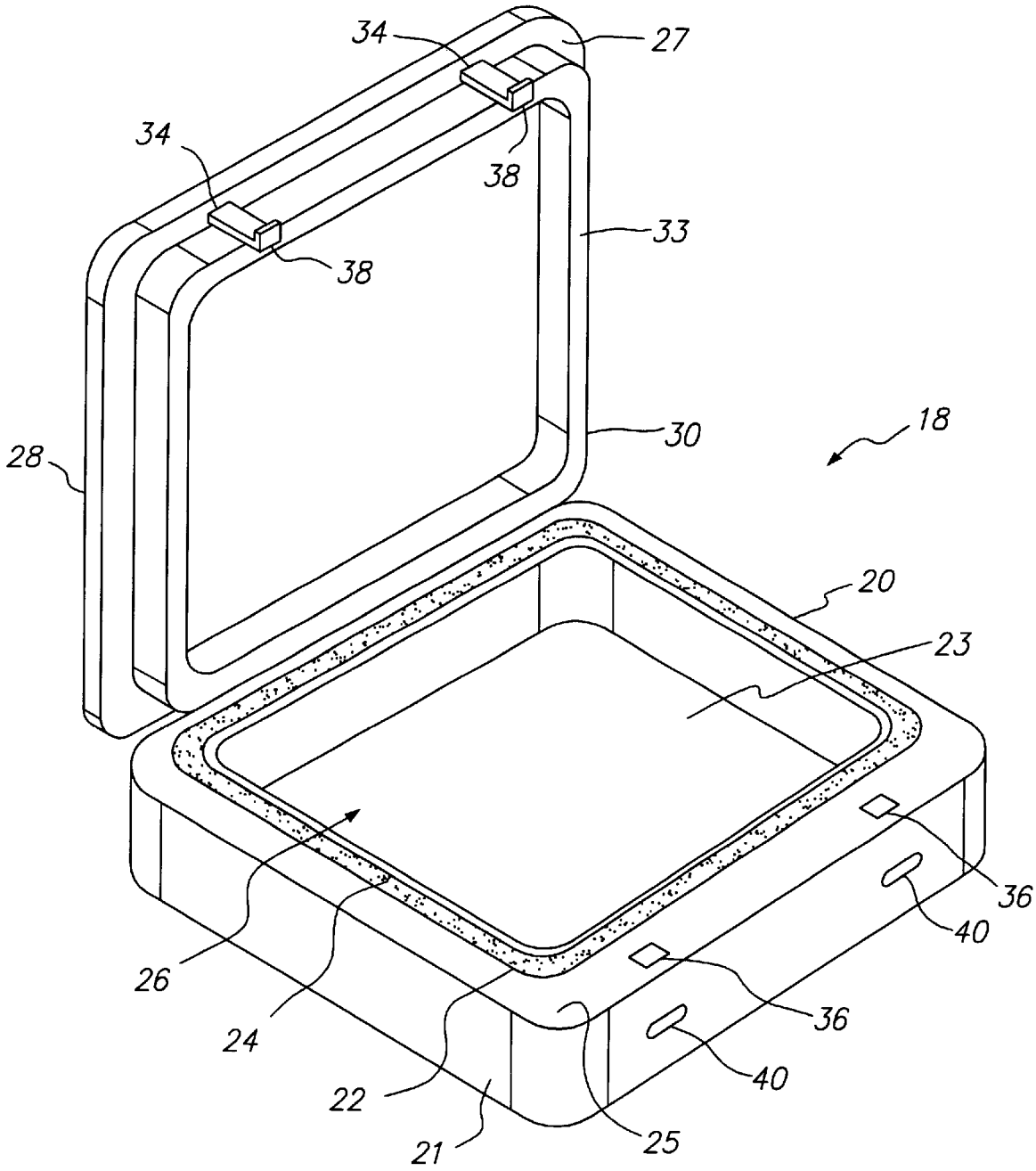
FIG. 1 shows a perspective view of an unsealed enclosure, including a cover attachable to a base, the enclosure constructed in accordance with the invention.

FIG. 1 shows a perspective view of an opened (unsealed) enclosure 18, including a base 20 having an attachable cover 28. The base 20 is generally box-shaped, with four rectangular side walls 21 and a bottom 23, which define (when the cover 28 is attached to the base 20) an environmentally-sealed chamber 26. The base 20 has a generally planar mating surface 25 formed by upward-facing ends (relative to the bottom 23) of the respective side walls 21. A mating groove 22 is formed in, and extends around the periphery of, the base mating surface 25. The cover has a generally planar mating surface 27 oriented in a direction facing the base 20 when the cover 28 is attached thereto.

A mating tongue 30 extends from the periphery of the cover mating surface 27, the tongue 30 disposed so as to be received in the mating groove 22 when the cover 28 is attached to the base 20. In the preferred enclosure 18, the tongue 30 is a protuberant lip extending from, and substantially perpendicular to, the planar cover mating surface 27. For reasons described in greater detail herein, the tongue 30 is preferably manufactured from a substantially clear (i.e., non-opaque) material (e.g., plastic) having a refractive index greater than 1.42. In the enclosure 18 shown in FIGS. 1–5, the tongue 30 has a generally planar distal end, or "contact face" 33, although other distal end geometries may be preferred, and further examples are described herein in conjunction with FIGS. 6–13. It is within the scope of the present invention to form a mating groove in the cover and to form a mating tongue in the base.

Depending on the intended use, the base 20 and cover 28 may be fabricated from any material, including injected molded plastic. Notably, parts fabricated from such material usually have loose manufacturing tolerances, warping, and inconsistent surface finishes. Preferably, the joints between the respective side walls 21 and between the bottom 23 are environmentally sealed (i.e., moisture and air tight). In some embodiments, the tongue 30 may be integrally formed (e.g. molded) as part of the cover 28.

The cover 28 has a pair of fasteners 34 extending from one end of the cover mating surface 27, which are inserted through a corresponding pair of guide holes 36 located in the corresponding end of the base mating surface 25 as the cover 28 is attached to the base 20. The fasteners 34 are generally resilient, each having an end flange 38. The guide holes 36 extend into the respective base side wall 21, and are in communication with respective latching slots 40 disposed in the side wall 21. In this manner, as the fasteners 34 are extended into the guide holes 36, the resilience of the fasteners 34 causes the end flanges 38 to snap into the corresponding latching slots 40, thereby securing the cover 28 to the base 20. The cover 28 may be released from the base 20 by depressing the respective end flanges 38 back into the latching slots 40, allowing the fasteners 34 to be withdrawn from the guide holes 36. The cover 28 may be alternately secured to the base 20 in any number of known fastening means, such as, e.g., snaps, ratcheting threads, straps, or guides. Also, the cover 28 may be hingedly attached to the base 20 at one end, or completely detachable.

Figure 3:
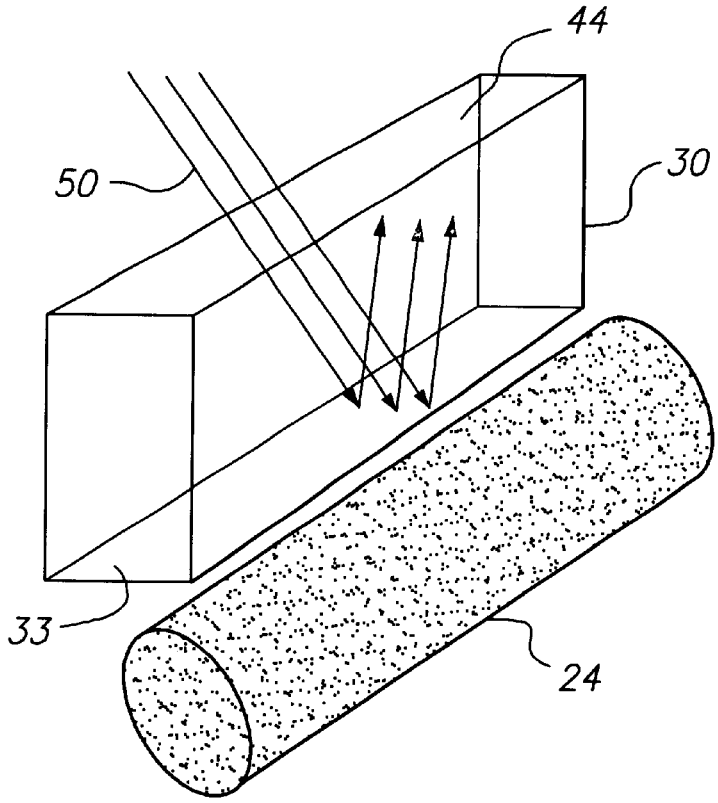
FIG. 3 shows a perspective view of a detail of the enclosure, in particular showing a non-opaque mating tongue extending from an interior mating surface of the cover (not shown), towards (but not in contact with) a gel sealant located in a mating groove on the surface of the base (not shown).

In order to form an environmentally tight seal between the tongue 30 and groove 22, a gel sealant 24 is disposed in the groove 22. As used herein, the term "gel," "gel material," or "gel sealant" is intended to encompass liquid-extended polymer compositions. The gel 24 preferably has a Voland Hardness of about 1 to about 525 g., more preferably about 5 to about 300 g, and most preferably about 5 to about 100 g., and also preferably has an ultimate elongation of at least about 50%, preferably at least about 100%. The elongation is measured according to the procedures of ASTM D217. The Voland hardness is measured using a Voland-Stevens Texture analyzer Model LFRA having a 1000 g load cell, a 5 gram trigger, and a ¼ inch(6.35 mm) ball probe. For measuring the hardness of a gel a 20 ml glass scintillating vial containing 10 grams of gel is placed in the Voland-Stevens Texture analyzer and the stainless steel ball probe is forced into the gel at a speed of 2.0 mm a second to a penetration distance of 4.0 mm. The Voland Hardness value of the gel is the force in grams required to force the ball probe at that speed to penetrate or deform the surface of the gel the specified 4.0 mm. The Voland Hardness of a gel may be directly correlated to the ASTM D217 cone penetration hardness and the procedure and a correlation is shown in FIG. 3 of U.S. Pat. No. 4,852,646 to Dittmer et al, the disclosure of which is incorporated herein by reference.

The gel sealant 24 is preferably a liquid-extended polymer network. The polymeric component can be for example, a silicone, polyorgano siloxane, polyurethane, polyurea, styrene-butadiene and/or styreneisoprene block copolymers. The gel 24 may be formed from a mixture of such polymers. The gel 24 may alternately comprise a foam or fabric impregnated with the gel. Examples of preferred sealant gels can be found in U.S. Pat. No. 4,600,261 to Debbaut, U.S. Pat. No. 4,716,183 to Gamarra et al, U.S. Pat. No. 4,777,063 to Dubrow et al U.S. Pat. No. 4,864,725 to Debbaut et al, and U.S. Pat. No. 4,865,905 to Debbaut et al, European published patent application Ser. No. 204,427 to Dubrow et al and International published patent applications Nos. 86/01634 to Toy et al, and WO 88/00603 to Francis et al, commonly assigned U.S. application Ser. No. 317,703 filed Mar. 1, 1990 to Dubrow et al, now abandoned, and U.S. Pat. No. 5,079,300, containing the subject matter of that application, and commonly assigned U.S. application Ser. No. 485,686 filed Feb. 27, 1990 to Rinde et al, now abandoned, and U.S. Pat. No. 5,104,930, containing the subject matter of that application. The entire disclosures of the above are incorporated by reference herein for all purposes. Gel impregnated in a matrix is disclosed in U.S. Pat. No. 4,690,831 to Uken et al and U.S. Pat. No. 4,865,905 to Debbaut et al, the entire disclosures of which are incorporated herein by reference for all purposes.

The gel sealant 24 is preferably resiliently deformable, and when compressed is capable of flowing and conforming around intricate shapes and adhering to solid surfaces. Because of their extremely soft and compliant nature, gels are particularly suitable for sealing items that are slightly warped, manufactured with loose tolerances, manufactured with high surface roughness, or made from materials such as injected molded plastic that contain some or all of the preceding features. Such gels will move between the surfaces to be sealed filling the voids and adhering to the sealing surfaces. Such gels are also uniquely suited for sealing because the gel forms a seal upon contact with a surface without the application of undue compressive force, although the gel 24 continues to seal under the application of considerable compressive force. These properties are exploited in this invention to produce an environmental seal that may be visually identified, as further described herein.

Because the gel 24 and not the mating surfaces 25 and 27 provides the environmental seal, it is not necessary that the respective mating surfaces 25 and 27 contact each other when the cover 28 is secured to the base 20. However, close contact between the respective mating surfaces 25 and 27 may be desirable depending on the application, e.g., to protect the gel 24 from contaminants. In alternate embodiments, the gel 24 may be disposed directly on either of the base or cover mating surfaces 25 and 27 (i.e., without any mating groove 22). A mating tongue 30 extending from the cover mating surface 27 is preferably still used in such an embodiment, although the gel 24 can also provide a seal directly between the respective mating surfaces 25 and 27.

Figure 2:
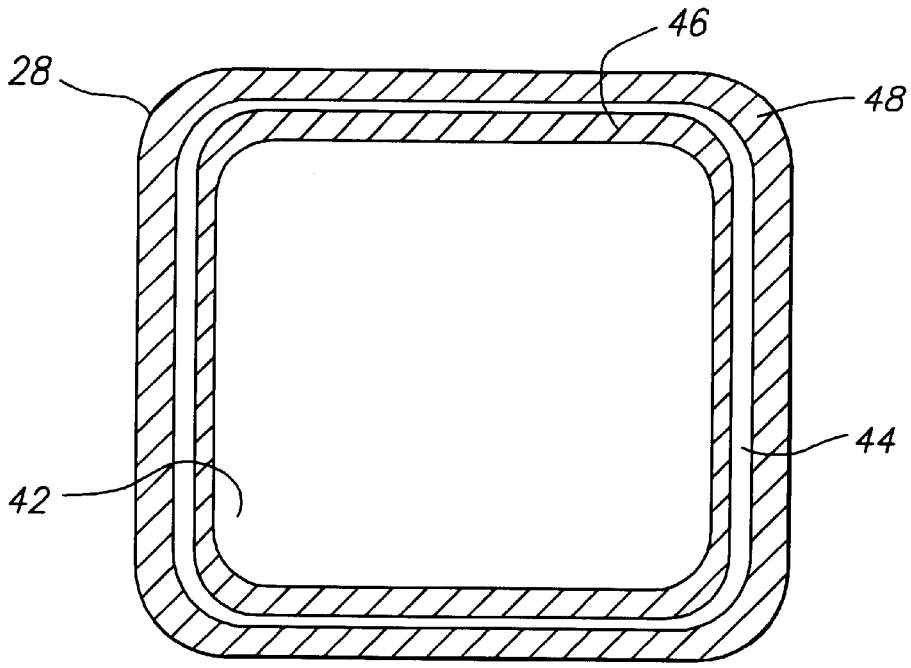
FIG. 2 shows a top plan view of an exterior surface of the cover, when the cover is not sealed to the base.
Figure 4:
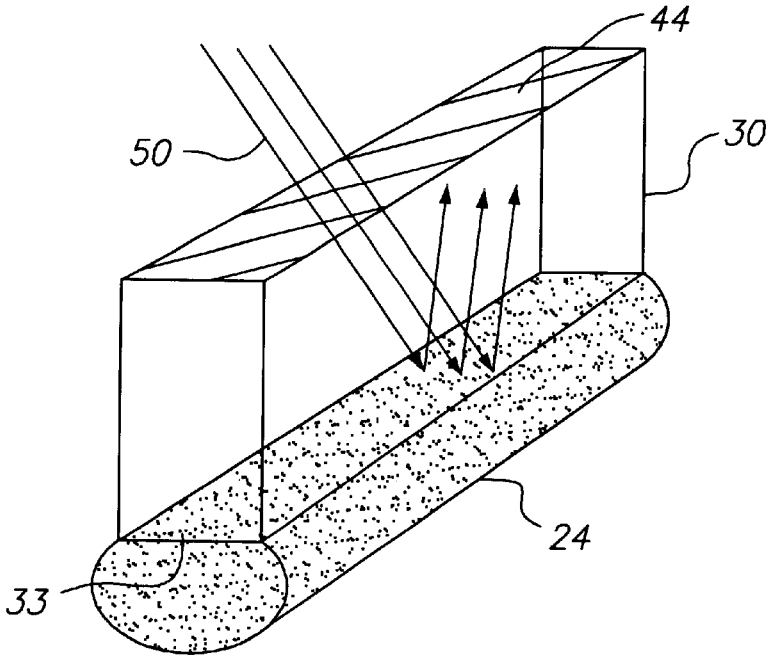
FIG. 4 depicts the detail of the enclosure shown in FIG. 3, with the tongue contacting and compressing the gel.

FIG. 2 shows a top planar view of an exterior surface 42 of the cover 28 (i.e., facing away from the base 20 when the cover 28 is attached thereto). In accordance with a main aspect of the invention, a clear (i.e., substantially non-opaque) observation window 44 is provided about the perimeter of the cover 28. In particular, the observation window 44 extends through the cover 28, is aligned with, and has approximately the same width as, the tongue 30. As best seen in FIGS. 3 and 4, because the tongue 30 is also comprised of a substantially non-opaque material, the observation window 44 and tongue 30 collectively comprise a light pipe for observing the gel sealant 24 through the exterior surface 42 of the cover 28.

Figure 5:
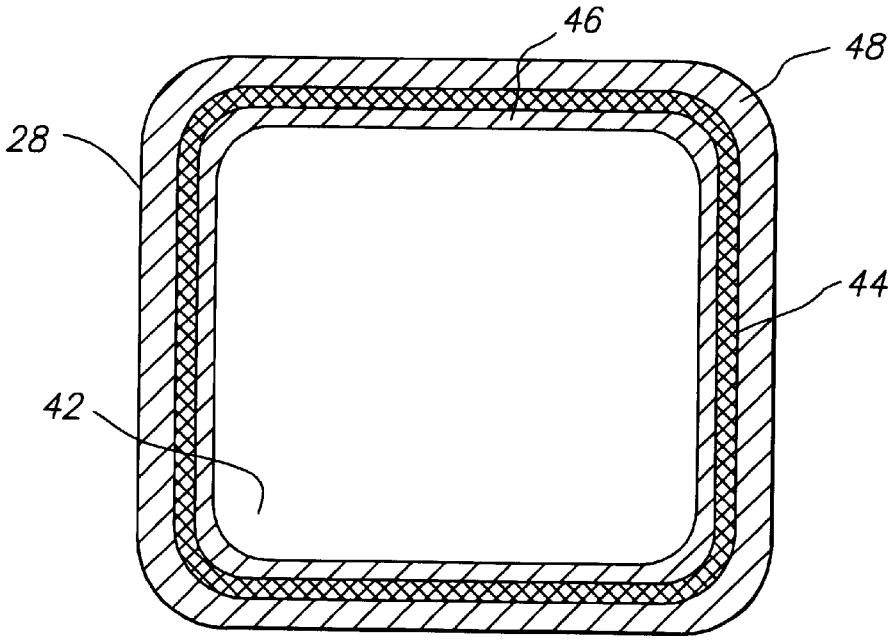
FIG. 5 shows a top plan view of the cover exterior surface, when the tongue has formed a seal with the gel.

More particularly, with reference to FIG. 3, when the enclosure 18 is not sealed, ambient light waves (depicted by arrows 50) passing through the light pipe (i.e., observation window 44 and tongue 30) reflect off the contact face 33 of the tongue 30 and are scattered. In this instance, the gel 24 will (at most) appear unclear, or "fuzzy," to an observer viewing through the observation window 44 from the exterior surface 42 of the cover 28. However, as shown in FIGS. 4 and 5, once the tongue 30 is pressed against the gel 24, thereby causing the gel 24 to "wet" the contact face 33 of the tongue 30 and form a seal therewith, the light waves substantially pass through the contact face 33 and through the gel 24, reflecting instead off the surface of the underlying mating groove 22 in the base 20. Thus, the observer will see a dramatic difference in the appearance and color of the reflected light waves 50 through the observation window 44, if the gel 24 is in sealing contact with the contact surface 33 of the tongue 30.

As will be appreciated, this aspect of the invention provides for ease in observing whether a complete seal is formed between the gel 24 and tongue 30, as any debris or impurities carried on the surface of the gel 24, or otherwise obstructing a full seal from being formed, will be readily observable through the light pipe. This allows an observer to view the quality of the contact between the tongue contact face 33 and the gel, and thus the quality of the seal.

As shown in FIGS. 2 and 5, the cover 28 may optionally be provided with substantially opaque portions 46 and 48 flanking either side of the observation window 44, so as to enhance the visual contrast provided by the window 44. Notably, while the observation window 44 of enclosure 18 is disposed around the entire cover 28, in other embodiments the observation window may only reveal portion of the sealing contact area, preferably the last section of the gel 24 to make sealing contact with the tongue 30. Further, in alternate embodiments, the observation window 44 in the cover may have a greater or lesser width than the tongue 30. With or without a mating tongue 30, the observation window 44 need only be sufficient to observe whether or not the gel 24 forms a seal with the cover mating surface 27.

With reference generally to the remaining FIGS. 6–13, visual indication of the seal may be enhanced by the design of the contact face 33 of the mating tongue 30.

Figure 6:
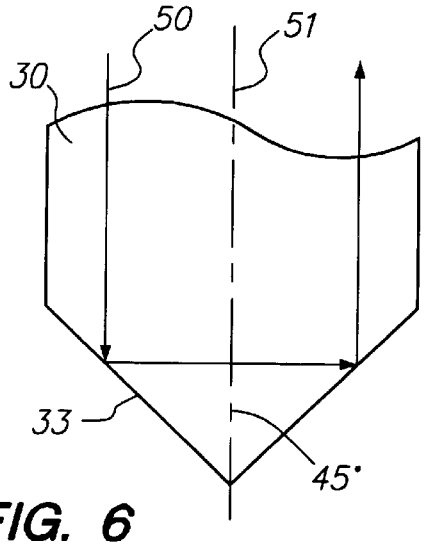
FIG. 6 is an enlarged cross-sectional view of an alternate mating tongue having a forty-five degree, beveled contact face.
Figure 7:
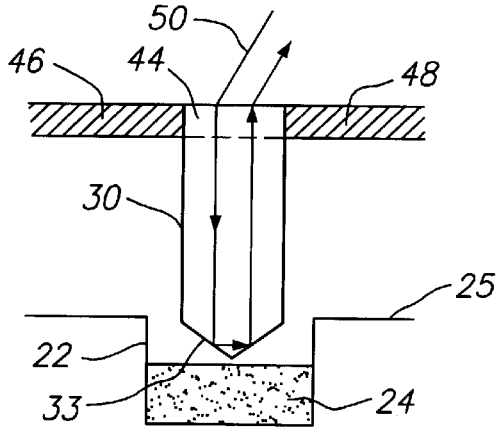
FIG. 7 depicts the tongue of FIG. 6 as the cover is moved towards the base, just prior to when the tongue contact face makes sealing contact with the gel.
Figure 8:
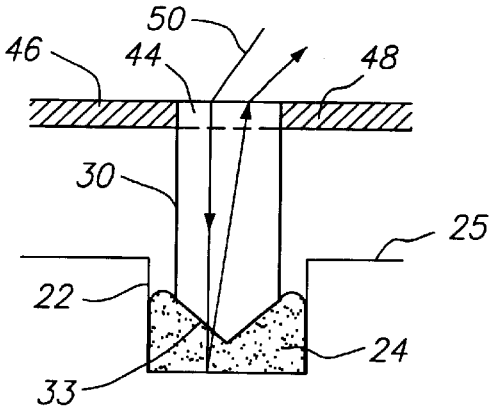
FIG. 8 depicts the tongue of FIG. 6 as the cover is moved towards the base, after the tongue contact face makes sealing contact with the gel.

FIGS. 6–8 depict a first alternate contact face 33 of the mating tongue 30 having a beveled edge cut at forty-five degrees along the center line of the tongue 30 (indicated by dashed line 51 in FIG. 6). This beveled edge design of the tongue contact face 33 substantially retains the reflected light in the tongue 30 and observation window 44, thereby enhancing the view through the light pipe both before (FIG. 7) and after (FIG. 8) sealing contact is made with the gel 24. An angle of forty-five degrees is especially useful because this angle, combined with the refractive index of typical clear plastics (e.g., a refractive index of greater than 1.42, e.g., 1.586 for polycarbonate, 1.651 for polysulfone, and 1.6 for polystyrene), will behave substantially as a total-reflection prism within the light pipe when the enclosure 18 is unsealed. With a total-reflection prism, an observer looking through observation window 44 will not be able to observe the gel 24 when the enclosure 18 is unsealed. While an angle of forty-five degrees is especially useful, sharp edges are easily damaged and it may be desirable to approximate the desired angle by rounding the edge of the angle.

Figure 9:
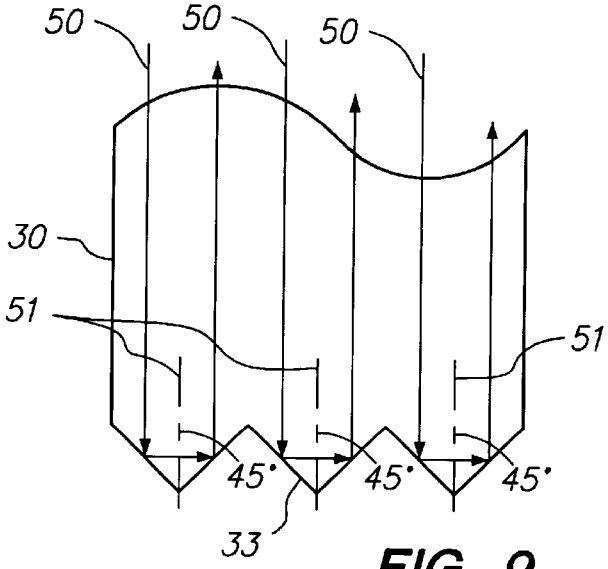
FIG. 9 is an enlarged cross-sectional view of further alternate mating tongue having a multi-beveled contact face.

By way of further example, FIG. 9 depicts a further alternate tongue contact surface geometry, in which there are multiple forty-five degree bevels for providing improved visual contrast between a sealed and unsealed condition. The multiple bevels also provide increased surface area between the contact face 33 and gel 24. In particular, one or more beveled edges on the contact face 33 provides better sealing over the planar contact face of the embodiment of FIGS. 1–6, as the beveled contact face is able to be "buried" into the gel (shown in FIG. 8) when the enclosure is sealed.

Figure 10:
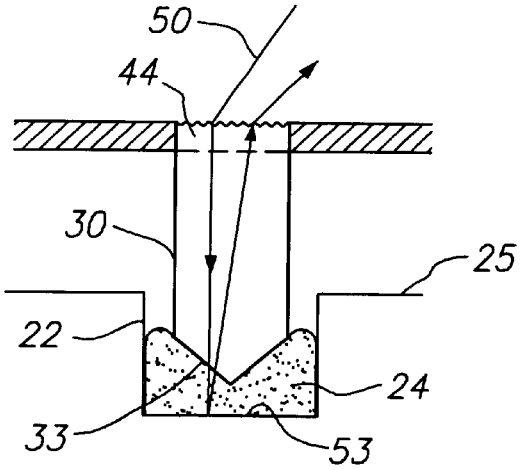
FIG. 10 illustrates a first preferred method for enhancing the visual confirmation of the seal between the tongue contact face and the gel.
Figure 11:
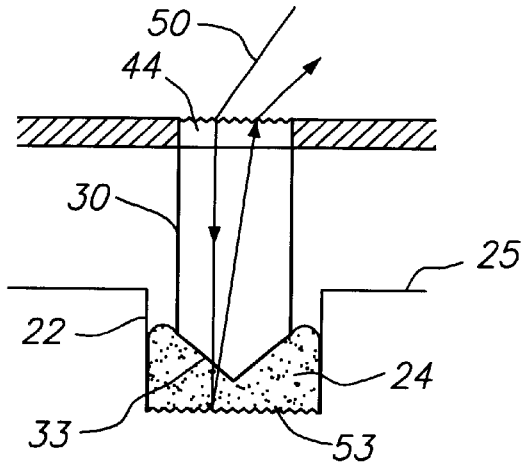
FIG. 11 illustrates another preferred method for enhancing the visual confirmation of the seal between the tongue contact face and the gel.

In a preferred embodiment, the gel 24 is sufficiently brightly color pigmented, such that much if not all of the ambient light 50 is reflected off of the gel surface (as shown in FIG. 10), instead of passing through the gel 24 and reflecting off the surface 53 of the groove 22. Alternately, the gel 24 may be lightly pigmented and the groove surface 53 brightly, or reflectively colored (as shown in FIG. 11), so that the ambient light 50 mostly passes through the gel 24 and is reflected back from the groove surface 53. In still other embodiments, a combination of gel pigmentation and the color of groove surface 53 may be used to provide sharp contrast through the light pipe to distinguish a sealed versus unsealed condition. Towards this end, the respective gel and groove surface colors can be selected to either reinforce each other, or combine to create a new color (e.g., green from yellow and blue).

Notably, in still further embodiments, the tongue contact face 33 may also be provided with a color pigmentation, such that when the enclosure is unsealed, the observation window 44 emits the reflected color of the contact face 33, and when the enclosure is sealed, the observation window 44 emits the combined reflected color of the gel and the contact face. This approach may be especially useful when the area surrounding the observation window in the cover is non-opaque and there is a possibility of viewing the gel 24 through a parallel light pipe adjacent the observation window 44. Also, the proximal surface of the tongue 30 and/or observation window 44 may also be pigmented or colored to enhance the visual contrast between a sealed and unsealed enclosure.

Figure 12:
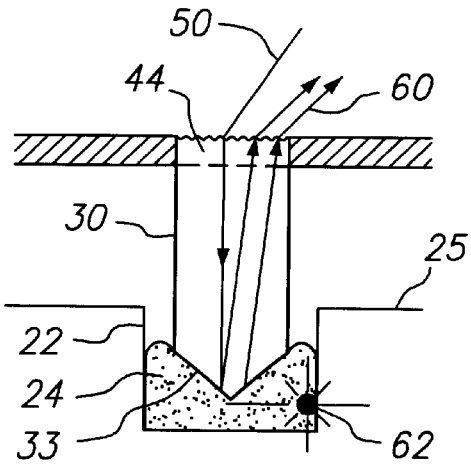
FIG. 12 illustrates still another preferred method for enhancing the visual confirmation of the seal between the tongue contact face and the gel.

In another still another preferred embodiment, shown in FIG. 12, one or more light emitting diodes (LEDs) 62 are embedded into, or otherwise in contact with, the gel 24. The one or more LEDs 62 produce additional light waves (shown as arrows 60 in FIG. 12), which travel through the light pipe (tongue 30 and observation window 44) when the contact face 33 contacts the gel 24. An advantage of this approach is that it functions with or without an ambient light source 50.

Figure 13:
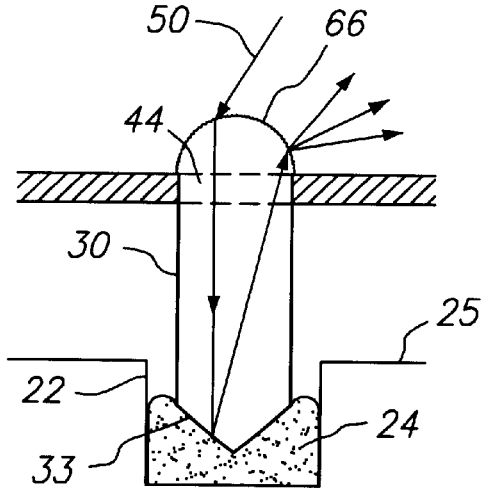
FIG. 13 illustrates a further alternate preferred embodiment of the enclosure with a protrusion on the exterior surface of the cover overlaying an observation window.

In the preferred embodiment, the area of the cover 28 surrounding the observation window 44 is treated to enhance the contrast between the visual effect of a sealed and unsealed enclosure. Such treatments may include frosting the adjacent areas (such as areas 46 and 48 shown in FIGS. 2 and 5), or contrasting the colors of the respective areas. Yet another approach, depicted in FIG. 13, is providing a raised (e.g., hemispherical) protrusion 66 over the light pipe/observation window 44, so that the visual confirmation of the contact between the gel 24 and the tongue contact face 33 can be observed from greater distances and more obtuse angles. This further feature may be implemented as stand-alone visual enhancement features, or can be combined with one or more other visual enhancement features.

In accordance with a further aspect of the invention, the visual indicator aspects of the above-described environmental enclosures can be applied to any sealing assembly, e.g., a hermetically sealed door.

Although the invention has been described and illustrated in the above description and drawings, it is understood that this description is by example only and that numerous changes and modifications can be made by those skilled in the art without departing from the scope of the invention.

The invention, therefore, is not to be restricted, except by the following claims and their equivalents.

What is claimed:

1. A sealable enclosure, comprising:

a base;

a cover attachable to the base, the base and cover each having a mating surface, the base and cover forming a chamber there between when the cover is attached to the base;

a compliant gel sealant disposed on the mating surface of one of the base and cover for environmentally sealing the chamber;

a non-opaque window formed in the cover, a non-opaque mating surface formed on the other of the base and cover, the mating surface being aligned with the window such that a line of sight is provided through the window and mating surface; and a visual indicator for determining that the chamber is sealed, the visual indicator comprising a wetted contact formed between the gel and mating surface, visible through the line of sight, indicating that an environmental seal is formed between the gel and mating surface.

2. The enclosure of claim 1, wherein the gel is a different color than at least one of the base or cover.

3. The enclosure of claim 1, further comprising a Light Emitting Diode embedded in or in contact with the gel.

4. A sealable enclosure, comprising:

a base;

a cover attachable to the base, the base and cover each having a mating surface, the base and cover forming a chamber there between when the cover is attached to the base;

a compliant gel sealant disposed on the mating surface of one of the base and cover for environmentally sealing the chamber; and a visual indicator for determining that the chamber is environmentally sealed, the visual indicator comprising a wetted contact formed between the gel and cover.

5. The enclosure of claim 4, wherein the visual indicator comprises a non-opaque window formed in the cover.

6. The enclosure of claim 5, wherein the cover comprises a non-opaque protrusion formed over the window.

7. The enclosure of claim 6, wherein the protrusion is semicircular in shape.

8. The enclosure of claim 5, wherein the gel is substantially aligned with the window when the cover is attached to the base.

9. The enclosure of claim 5, wherein the cover comprises a substantially opaque portion adjacent to the window, thereby providing a visual contrast between the opaque portion and the window.

10. The enclosure of claim 5, wherein the base and is a different color than the gel.

11. The enclosure of claim 4, wherein the visual indicator comprises a non-opaque window formed in the cover, and a non-opaque tongue extending from the mating surface of the cover, the tongue aligned with the window such that a line of sight is provided through the window and tongue.

12. The enclosure of claim 11, wherein the tongue has a triangular-shaped distal end with an apex formed at a slope on either side of approximately 45°.

13. The enclosure of claim 1, further comprising a latching mechanism for securing the cover to the base.

14. A sealable enclosure, comprising:

a base having an exterior surface, a channel formed about a perimeter of the exterior base surface;

a compliant gel sealant disposed in the channel; and a cover attachable to the base, the cover having an exterior surface and an interior surface, a raised sealing tongue extending from the interior cover surface about a perimeter thereof, the tongue adapted to make sealing contact with the gel as the cover is moved towards the base to thereby form an environmental seal between the base and cover;

the cover comprising a non-opaque portion allowing for visual indication of whether or not a seal is formed between the tongue and the gel.

15. The enclosure of claim 14, the cover further comprising an opaque portion adjacent to the non-opaque portion so as to enhance the visual confirmation of a seal formed between the cover and the gel.

16. The enclosure of claim 14, the exterior cover surface comprising a raised surface protrusion substantially aligned with the non-opaque portion.

17. A sealable enclosure, comprising:

a base;

a cover attachable to the base, the base and cover each having a mating surface, the base and cover forming a chamber there between when the cover is attached to the base;

a compliant the gel sealant disposed on the mating surface of the base for environmentally sealing the chamber; and a visual indicator for determining that the chamber is sealed, said visual indicator comprising a non-opaque window formed in the cover, and a non-opaque tongue extending from the mating surface of the cover, the tongue aligned with the window such that a line of sight is provided through the window and tongue, wherein the gel is substantially aligned with the tongue when the cover is attached to the base, such that a wetted contact between the gel and a distal end of the tongue, indicating that an environmental seal is formed there between, is visible through the line of sight.

18. A sealable enclosure comprising:

a base;

a cover attachable to the base, the base and cover each having a mating surface, the base and cover forming a chamber there between when the cover is attached to the base;

a compliant gel sealant disposed in a groove formed in the mating surface of the base for environmentally sealing the chamber; and a visual indicator for determining that the chamber is sealed, said visual indicator comprising a non-opaque window formed in the cover, and a non-opaque tongue extending from the mating surface of the cover, the tongue aligned with the window such that a line of sight is provided through the window and tongue, the groove being substantially aligned with the tongue when the cover is attached to the base, such that a wetted contact between the gel and a distal end of the tongue, indicating that an environmental seal is formed there between, is visible through the line of sight.

19. A sealable enclosure, comprising:

a base;

a cover attachable to the base, the base and cover each having a mating surface, the base and cover forming a chamber there between when the cover is attached to the base;

a compliant gel sealant disposed on the mating surface of one of the base and cover for environmentally sealing the chamber; and a visual indicator for determining that the chamber is sealed; wherein the visual indicator comprises:

a non-opaque window formed in the cover comprises a clear plastic having a refractive index of greater than 1.42, and a non-opaque tongue extending from the mating surface of the cover the tongue aligned with the window such that a line of sight is provided through the window and tongue.

20. A sealable enclosure comprising:

a base;

a cover attachable to the base, the base and cover each having a mating surface, the base and cover forming a chamber there between when the cover is attached to the base;

a gel sealant disposed on the mating surface of one of the base and cover for environmentally sealing the chamber; and means for providing a visual indication of whether or not a seal is formed, the visual indication being in the form of wetted contact between the gel and cover mating surface.

21. A sealable assembly, comprising:

a fixed surface defining an opening;

a compliant gel sealant disposed about the opening; and a cover having an exterior surface and an interior surface, the cover attachable to the fixed surface so as to form a substantially moisture-tight seal between the interior cover surface and the gel, the exterior cover surface providing a visual indication of whether or not a seal is formed.

* * * * *